United States Patent [19]

Meili

[11] Patent Number: 4,674,142

[45] Date of Patent: Jun. 23, 1987

[54] FLOOR CLEANING MACHINE

[75] Inventor: Hermann Meili, Münchwilen, Switzerland

[73] Assignee: Internationale Octrooi Maatschappij, Rotterdam, Netherlands

[21] Appl. No.: 767,877

[22] Filed: Aug. 21, 1985

[30] Foreign Application Priority Data

Aug. 28, 1984 [GB] United Kingdom ..... 8421713

[51] Int. Cl.[4] ..... A47L 11/16; A47L 11/293

[52] U.S. Cl. ..... 15/49 R; 15/50 R; 15/320; 51/177

[58] Field of Search ..... 15/49 R, 50 R, 320, 15/340, 87, 98; 51/177

[56] References Cited

U.S. PATENT DOCUMENTS

| | | | |
|---|---|---|---|
| 2,978,719 | 4/1961 | Arones | 15/49 R |
| 3,712,399 | 1/1973 | Ruffle et al. . | |
| 3,818,292 | 6/1974 | Berman . | |
| 4,218,798 | 8/1980 | Block | 15/49 R |
| 4,490,873 | 1/1985 | Stratton | 15/49 R |

*Primary Examiner*—Edward L. Roberts

*Attorney, Agent, or Firm*—Cushman, Darby & Cushman

[57] ABSTRACT

The invention pertains to a floor cleaning machine comprising an electrical means for controlling the operation of the brush head lever motor to maintain the brush pressure at an operator-set value. An improved brush pressure regulating system which is operator-adjustable, is provided.

8 Claims, 3 Drawing Figures

FLOOR CLEANING MACHINE

BACKGROUND OF THE INVENTION

The present invention relates to floor cleaning machines and in particular to automatic floor cleaning and treating machines which are used for the cleaning of hard surfaces of large floor areas, such as e.g. in hotels, factories, office buildings, shopping centers and the like.

In general such machines comprise a movable body supported by a pair of drive wheels and one or more caster wheels, the body carrying a brushing means, reservoirs for storing fresh and spent cleaning liquid, means for dosing fresh cleaning liquid onto the floor and a squeegee/vacuum pickup system for recovering spent cleaning liquid from the floor.

The brushing means normally comprises one or more rotatable brushes, a motor for driving the brushes and a means for lifting the brushes off the floor when large areas are traversed without any cleaning action being required.

A number of conventional floor cleaning machines also include an option for adjustment of the brush height with respect to the floor. In general adjustment of the brush height has to be done manually which severely limits the easy controllability during operation.

In view of uniform cleaning, wear of the brushes and energy consumption, it is often more advantageous to control not so much the brush heigth, but the brush pressure. In U.S. Pat. No. 4,218,798 a control system has been disclosed whereby the brush pressure is operator-adjustable. Brush pressure control is achieved by means of a hydraulic/pneumatic actuator system whereby the pressure level is adjustable by way of a pressure regulator.

SUMMARY OF THE INVENTION

It is an object of the present invention to provide an electric brush-pressure regulating system. It is a further object to provide such a system for automatic control of the brush pressure which is instantly operator-adjustable.

Accordingly, in its broadest aspect the present invention provides a floor cleaning machine comprising a motor-driven movable body carrying a scrubber assembly which comprises a brush head housing one or more rotatable brushes, a motor for driving the brushes, a lever for lifting and lowering the brush head, and a motor for engaging the lever between a lifted and a lowered position, characterized in that the scrubber assembly comprises a control means for electrically controlling the operation of the lever motor to maintain the brush pressure at an operator-set value.

In a first preferred aspect of the invention the control means comprises an electronic device which controls the lever motor by way of pulse width modulation. Pulse width modulation is a well-known method of controlling the motor voltage allowing easy electronic adjustment thereof to an operator-set value.

In a further preferred aspect of the invention a sensoring device is incorporated for measuring the brush pressure, the control means being electrically connected to the sensoring device and the lever motor. In this arrangement the control means operates the lever motor on the basis of the feed-back output signal of the sensoring device, which is proportional to the instant brush pressure. In general the sensoring device will not measure the brush pressure directly, but by way of a related physical quantity proportional to the brush pressure, such as the deformation of parts or portions of parts of the scrubber assembly which are under a stress proportional to the brush pressure, or the instant power consumption of the lever motor.

A preferred brush pressure sensoring device consists of an ammeter which measures the amperage of the lever motor. Being proportional to the torque of the lever motor, this amperage is proportional to the brush pressure, accordingly providing a suitable feed back to the control means.

In a further preferred aspect of the invention the brush pressure sensoring device comprises a deformation-sensitive component. Such component is suitably attached to the surface of or incorporated in a stress-deformable portion of the lever. The deformation-sensitive component may be any electrical or electronic device suitable for the purpose. Preferably it consists of a Hall element. A Hall element is a device which is based on the Hall effect whereby a transverse electromotive force is produced in a current-carrying conductor or semi-conductor subjected to a magnetic field. Instead of an Hall element a deformation-dependent resistance (strain gauge) may also advantageously be used.

In a further aspect of the invention the lever is tensioned by an extension spring counter-acting the lever motor. Preferably the lever motor is a stepper motor. The brush pressure is proportional to the extension of the spring which in turn is linear to the number of steps of the stepper motor. Suitably also, a deformation-sensitive component may be incorporated in or connected to the extension spring for measuring the deformation thereof, which is proportional to the brush pressure.

BRIEF DESCRIPTION OF THE DRAWINGS

The invention will now be further illustrated with reference to the accompanying drawings in which.

DETAILED DESCRIPTION OF THE PREFERRED EMBODIMENT

Figure 1:
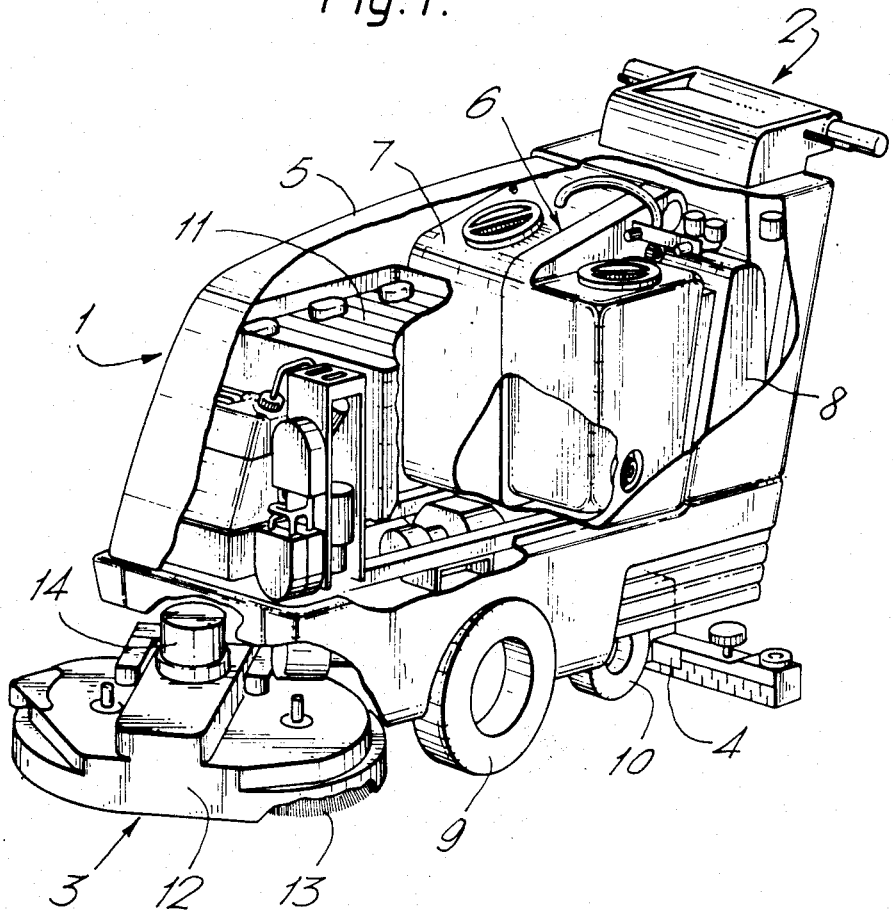
FIG. 1 is a perspective view of an automatic cleaning machine according to the present invention.

Referring now to FIG. 1 an automatic floor cleaning machine is shown, comprising a housing or body (1), a steering and controlling means (2), a scrubber assembly (3) and a squeegee (4). The body (1) has been drawn cut-open for illustration of the interior. It comprises a cover (5) for housing tank, battery, pump and motor parts. A storage tank (6) comprises a first reservoir (7) for storing fresh cleaning liquid and a second reservoir (8) for storing spent cleaning liquid. Although the two reservoirs may have a fixed separation wall, it is preferred that they are separated by way of a flexible membrane.

The cleaning machine is supported on main drive wheels (9) and one or more caster wheels (10). The driving motor means for wheels (9) is battery-operated enabling ready manoeuverability over a wide area. Although the use of a battery is preferred, if so desired the motors may also be energized from an external electrical source through a cord, thereby eliminating battery (11).

Figure 2:
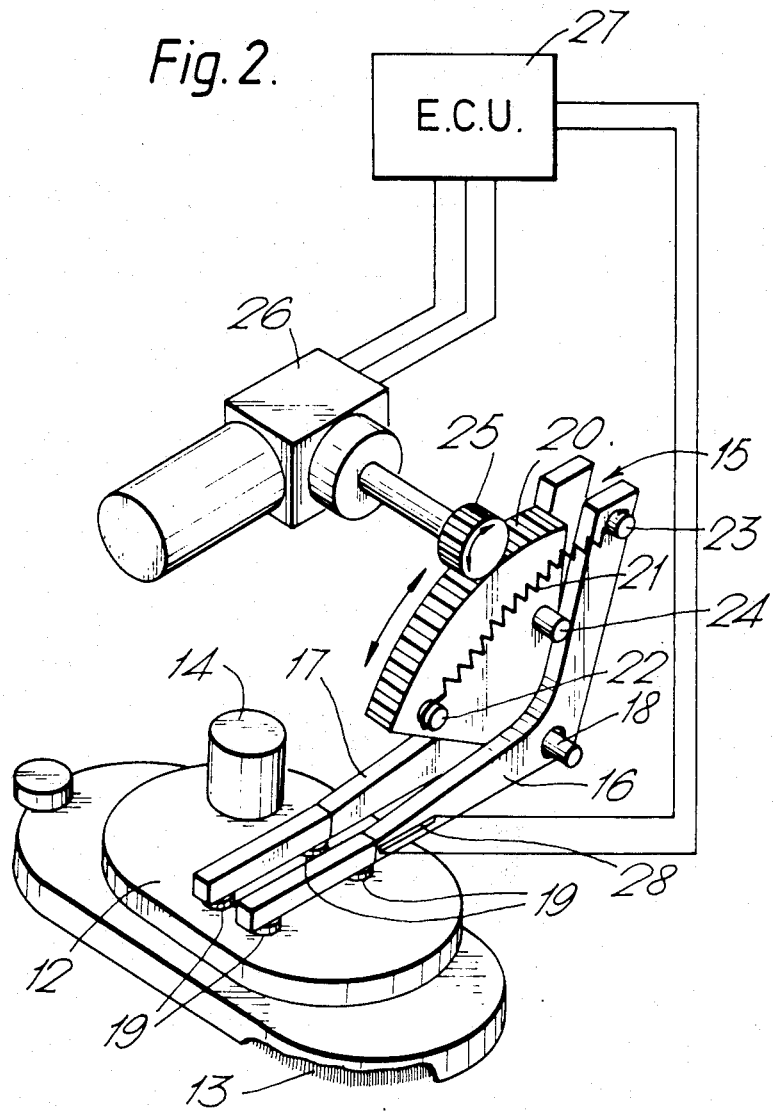
FIG. 2 is a perspective enlarged view of a preferred embodiment of the scrubber assembly according to the present invention.

A preferred embodiment of the scrubber assembly (3) is shown in more detailed form in FIG. 2. A brush head (12) houses two rotatable brushes (13) which are driven by motor means (14). The brush head (12) is carried by lever (15) comprising two arms (16) and (17) pivotably mounted on body (1) around pin pivot (18). To allow small variations in position of brush head (12) with respect to lever (15), elastic bearings (19) are mounted between the brush head and the lever arms. Between the two arms (16) and (17) a gear block (20) is pivotably mounted about pin pivot (18). Gear block (20) and lever (15) are spring-tensioned relative to each other by means of an extension spring (21) mounted between and to pegs (22) and (23). A peg stop (24) on gear block (20) is co-operable with arm (16) for preventing unrestricted backward movement of gear block (20) relative to lever (15).

Pinion (25) is co-operable with gear block (20) for transmitting the drive-force of motor means (26) to the tension-force of spring (21). Motor means (26) is electrically connected to an electronic control unit (ECU) (27). Clockwise or anti-clockwise rotation of pinion (25) results in a forward or backward pivoting movement of gear block (20) and, as a result, in an increased or decreased tension in extension spring (21). Proportional to the spring tension is the pressure exerted by lever (15) onto brush head (12) and accordingly, by the brushes onto the floor.

By moving the gear block to its fully backward position the brush head is lifted off the floor due to co-operation of the peg stop (24) and lever arm (16). Accordingly control of the operation of lever motor means (26) gives full control of the brush pressure, and lifting or lowering of the brush head (12).

A brush pressure sensoring device (28) is attached to the lower portion of the lever arm (16). The sensoring device is of the type which is deformation-sensitive, such as a Hall element or a deformation-dependent resistance. With increasing brush pressure the lower portion of the lever arm (16) is proportionally deformed resulting in a proportional fed-back output signal of device (28) to the ECU (27), which on the basis thereof controls the operation, direction and power output of the lever motor means.

In an alternative embodiment of the invention the deformation of the extension spring (21) is measured to which purpose similar deformation-sensitive components may be used.

In particular where energy economy is of no major importance, it may be preferred to avoid the incorporation of the sensoring device. Preferably lever motor means (26) is then controlled by the ECU by way of pulse width modulation, whereby the stall-voltage of the motor means is maintained at an operator-set value. Pulse width modulation allows easy and instant control, but in general requires that the motor is kept continuously energized.

Figure 3:
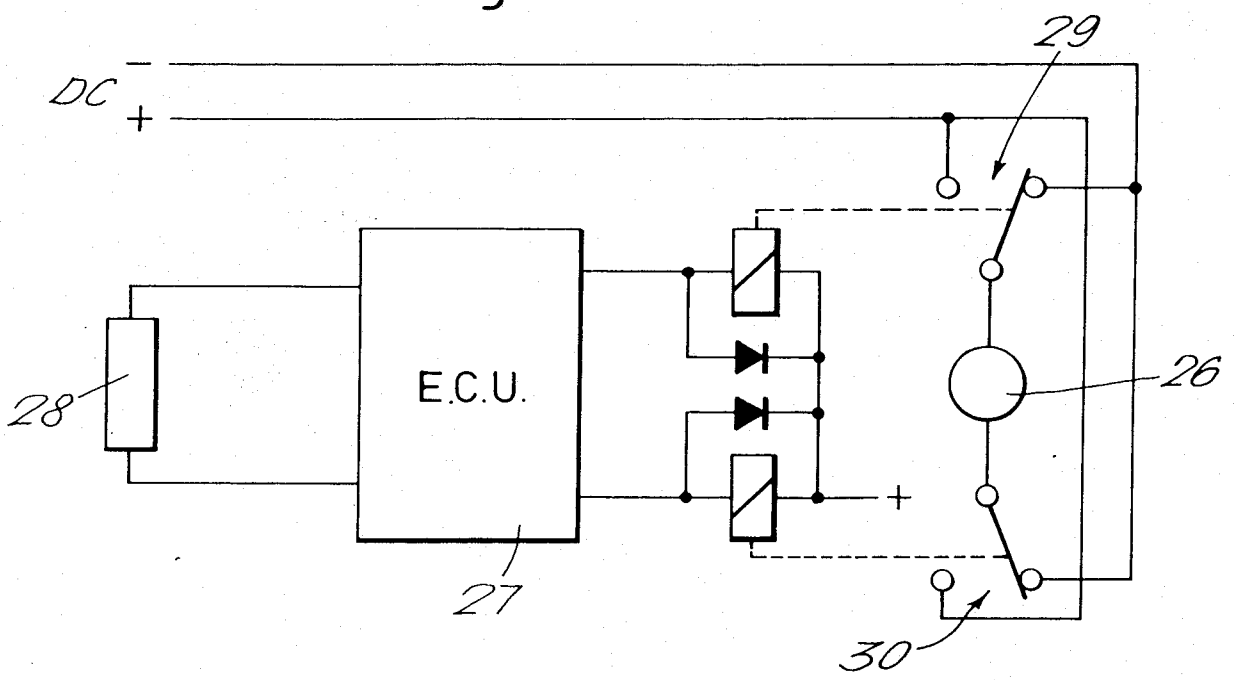
FIG. 3 is a circuit diagram showing a preferred control circuit for the lever motor means.

In FIG. 3 a preferred control circuit for motor means (26) is illustrated. The ECU (27) controls the switches (29) and (30) which open and close the energizing circuit of the lever motor means and may establish inversal of the motor current. When no action is required the switches are in the closed position, motor means (26) being short-circuited and remaining in the instant position corresponding to the brush pressure as set by the operator. When the output signal of the brush pressure sensoring device (28) no longer corresponds to the, operator-set value, the ECU opens the appropriate switch (29) or (30) until the operator-set value is reached.

In an alternative embodiment of the invention the sensoring device comprises an ammeter which measures the amperage of the lever motor means (26). On a time-interval basis one of the switches (29) or (30) corresponding to lowering of lever (15), is opened and the amperage is measured which is necessary to maintain lever (15) in position. When the amperage does not correspond to the operator-set value, the ECU opens the appropriate switch (29) or (30) until the operator-set amperage is reached.

I claim:

1. A floor cleaning machine, comprising:

a motor-driven movable body;

operator control means, coupled to said movable body, adapted for receiving an operator set value;

a scrubber assembly including a brush head housing at least one rotatable brush which is adapted for contacting said floor;

brush motor means for driving said brush;

lever means coupled to said scrubber assembly and to said movable body, for lifting and lowering said scrubber assembly with respect to said movable body;

lever motor means for driving said lever means to cause said scrubber assembly to be lifted and lowered;

brush pressure sensor means, coupled to said lever means, for detecting a pressure of said brush contacting said floor; and electronic control means responsive to the detected pressure and the operator set value, for controlling said lever motor means to cause said brush pressure to be maintained substantially at said operator set value.

2. A floor cleaning machine according to claim 1 further including extension spring means for counteracting said lever motor means.

3. A floor cleaning machine according to claim 2 wherein said lever motor means comprises a stepper motor.

4. A floor cleaning machine according to claim 1 wherein said electronic control means includes means for controlling said lever motor means by pulse width modulation.

5. A floor cleaning machine according to claim 1 wherein said lever motor means comprises an electrical motor having a current, and wherein said brush pressure sensor means comprises an ammeter for measuring said current of said lever motor means.

6. A floor cleaning machine according to claim 1 wherein said brush pressure sensor means comprises a deformation-sensitive component.

7. A floor cleaning machine according to claim 6 wherein said deformation-sensitive component comprises a Hall element.

8. A floor cleaning machine according to claim 6 wherein said deformation-sensitive component comprises a strain gauge.

* * * * *